US005791437A

United States Patent [19]

Figliuzzi

[11] Patent Number: 5,791,437

[45] Date of Patent: Aug. 11, 1998

[54] LADDER WITH NESTING BRACE GUSSET PLATE HINGE

[76] Inventor: Joseph Figliuzzi, H.C. 2, Box 39A, Kelliher, Minn. 56650

[21] Appl. No.: 322,612

[22] Filed: Oct. 13, 1994

[51] Int. Cl.[6] ..... E06C 1/22

[52] U.S. Cl. ..... 182/172; 182/107

[58] Field of Search ..... 182/165–171, 182/107; 16/367, 346

[56] References Cited

U.S. PATENT DOCUMENTS

| | | | |
|---|---|---|---|
| 346,437 | 7/1886 | Geissinger . | |
| 485,900 | 11/1892 | Tannenberg . | |
| 639,603 | 12/1899 | Nelson | 182/172 |
| 856,937 | 6/1907 | Bell | 16/333 |
| 943,236 | 12/1909 | Campbell . | |
| 1,135,336 | 4/1915 | Van Houten . | |
| 1,135,763 | 4/1915 | Caronia . | |
| 1,235,696 | 8/1917 | Keith . | |
| 1,415,791 | 5/1922 | Caronia . | |
| 1,526,654 | 2/1925 | Yordy . | |
| 1,610,596 | 12/1926 | Bird | 182/172 |
| 1,924,213 | 8/1933 | Newman . | |
| 2,008,582 | 7/1935 | Fredericksen | 182/172 |
| 2,364,048 | 12/1944 | Barkey . | |
| 2,750,246 | 3/1956 | Zielefeldt . | |
| 2,938,228 | 5/1960 | Crisera | 16/333 |
| 2,997,127 | 8/1961 | Wojtowicz . | |
| 3,396,928 | 8/1968 | Lay . | |
| 3,568,798 | 3/1971 | Pierce . | |
| 3,856,111 | 12/1974 | Stewart . | |
| 3,878,917 | 4/1975 | McBride . | |
| 4,565,262 | 1/1986 | Hawkins | 182/172 X |
| 4,681,187 | 7/1987 | Brown | 182/153 X |
| 4,798,262 | 1/1989 | Margolies | 182/172 X |
| 4,872,529 | 10/1989 | Viets . | |
| 4,964,488 | 10/1990 | Stewart . | |
| 5,069,144 | 12/1991 | Williford . | |

OTHER PUBLICATIONS

Compuserve Computer Search Dated Jul. 24, 1993; 14 pp.

Compuserve Computer Search Dated Jul. 25, 1993; 7, 6, 9 pp.

Compuserve Computer Search Dated Jul. 26, 1993; 14 pp.

Compuserve Computer Search Dated Jul. 30, 1993; 4 pp.

*Primary Examiner*—Alvin C. Chin-Shue

[57] ABSTRACT

A ladder with nesting braces device is disclosed which significantly improves the bilateral stability of the ladder minimizing risk of injury to an individual while simultaneously retaining a standard ladder design profile. The nesting braces internally receive the pair of side support rails during storage of the ladder. Each of the nesting braces includes a hinge engagement section having at least one locking mechanism. Each of the side support rails includes a hinge and a pair of gusset plates having a locking mechanism adapted for engagement to the hinge plates. The hinge and a corresponding hinge engagement section provides for the structural support and pivotal rotation of a nesting brace with respect to a side support rail. Each of the nesting braces may additionally include an expansible-leg having a releasable carriage/housing for vertical adjustment to securingly engage a surface during use of the ladder upon a non-level surface.

9 Claims, 7 Drawing Sheets

LADDER WITH NESTING BRACE GUSSET PLATE HINGE

BACKGROUND OF THE INVENTION

In the past, a number of devices have been attached to the side support rails of a ladder to reduce the risk of lateral tipping during periods of use. These devices were generally of insufficient structural support resulting in failure, especially during use in increased load situations. The devices utilized to provide bilateral support were additionally expandable in order to provide for engagement of the supports to a ground surface following the placement of a ladder in a desired location. The means employed for retention of the expandable features in an extended position also frequently failed as a result of inadequate structural design. Additionally, the devices utilized for bilateral support frequently increased the bulkiness, clumsiness, and storage space required for a ladder during periods of portability or non-use. In many cases these bulky and unbalanced devices made it difficult to use the ladder in a conventional manner and could only be used with the stabilizer supports fully engaged. In addition, these devices did not consider the importance of maintaining the natural design profile of the ladder. As a result, the stabilizer supports became "protruding appendages" that deviated considerably from standard ladder design which made them inconvenient or unsafe to operate.

The bilateral support devices as known fail to incorporate a hinge of increased structural strength and durability into a nesting brace for the provision of improved support for a ladder. The bilateral support devices as known have not provided a mechanism for automatically locking a hinge and a corresponding nesting brace into an operative position. These support devices also have not included a coupling feature for mating of the pair of side support rails into the nesting braces for convenient transportation and storage of a ladder. These support devices have not incorporated their side support rails into a profile of a standard ladder design making the side supports almost indistinguishable from the ladder itself in the closed or non-use position. Past support devices have not allowed for use of the ladder in a conventional manner without support braces. These devices have not added the benefit of a nesting ability, doubling the strength and support of existing ladder siderails when the ladder is used conventionally without the side support extended. Finally, the support devices as known have not included an expansible feature of sufficient strength and durability to support the use of a ladder upon a non-level surface during increased load situations.

SUMMARY OF THE INVENTION

A ladder with nesting braces device is disclosed which significantly improves the bilateral stability of the ladder minimizing risk of injury to an individual while simultaneously retaining a standard ladder design profile. The nesting braces internally receive the pair of side support rails during storage of the ladder. Each of the nesting braces includes a hinge engagement section having at least one locking mechanism. Each of the side support rails includes a hinge and a pair of gusset plates having a locking mechanism adapted for engagement to the hinge plates. The hinge and a corresponding hinge engagement section provides for the structural support and pivotal rotation of a nesting brace with respect to a side support rail. Each of the nesting braces may additionally include an expansible-leg having a releasable carriage/housing for vertical adjustment to securingly engage a surface during use of the ladder upon a non-level surface.

It is a principal object of the present invention to provide a new and improved ladder of relatively simple and inexpensive design, construction, and operation which is safe and durable and which fulfills the intended purpose without fear of injury to persons and/or damage to property.

It is another principal object of the present invention to minimize the risk of injuries to individuals by providing improved bilateral support of a ladder through use of structurally-enhanced nesting braces.

It is still another principal object of the present invention to improve the structural interaction of the pivotally-mounted nesting braces to the ladder.

It is another principal object of the present invention to incorporate this improved device in a manner that retains standard ladder profile and design.

It is still another principal object of the present invention to provide nesting braces which flushly receive the side support rails of the ladder for minimization of spacial requirements during periods of portability or non-use.

It is still another principal object of the present invention to provide an adjustable ladder for use upon non-level surfaces.

A feature of the present invention is a pair of nesting braces which are pivotally attached to the side support rails of a ladder via an improved hinge mechanism.

Another feature of the present invention is a pair of covering edges extending from each nesting brace which are adapted to flushly cover the exterior edges of a pair of side support rails during transportation or storage of the ladder.

Still another feature of the present invention is a hinge engagement section of each nesting brace having at least one locking mechanism.

Still another feature of the present invention is a hinge plate affixed or integral to each of the side support rails which is further pivotally engaged to a corresponding hinge engagement section of a nesting brace.

Still another feature of the present invention is a pair of gusset plates attached to each of the hinge plates where the gusset plates are automatically actuated and locked into an operative position with the locking mechanism upon pivotal rotation of a nesting brace outwardly from a side support rail.

Still another feature of the present invention is an expansible leg adjustably coupled to each of the nesting braces by a housing/carriage for vertical positioning upon a non-level surface.

Other objects and features of the present invention will hereinafter appear and for purposes of illustration but not a limitation. Other embodiments of the invention are shown on the accompanying drawings.

BRIEF DESCRIPTION OF THE DRAWINGS

FIG. 5 is a detail view of a hinge including gusset plates as attached to a hinge engagement section.

DETAILED SPECIFICATION OF THE PREFERRED EMBODIMENT

Figure 1:
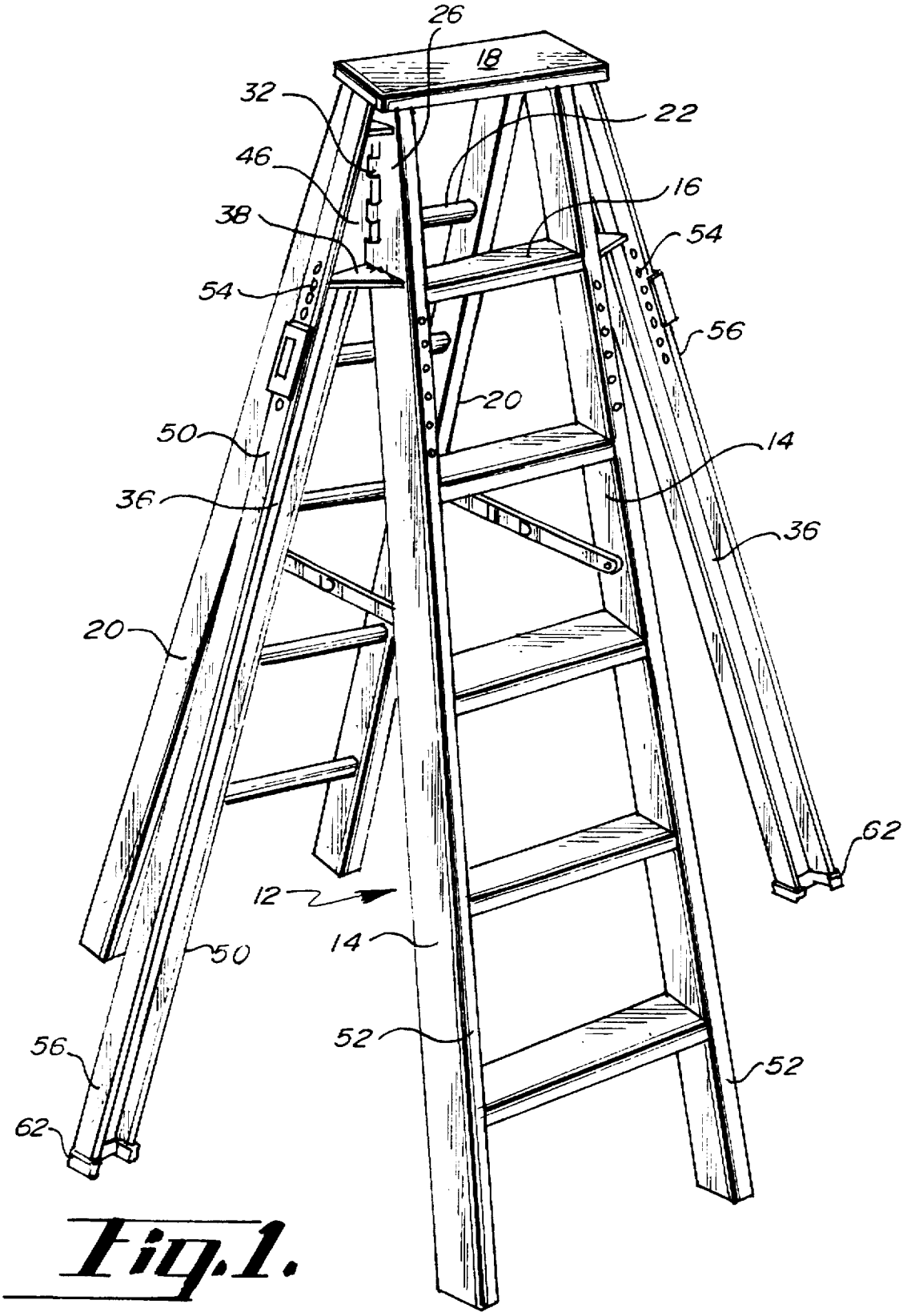
FIG. 1 is an isometric view of the ladder with nesting braces device.
Figure 2:
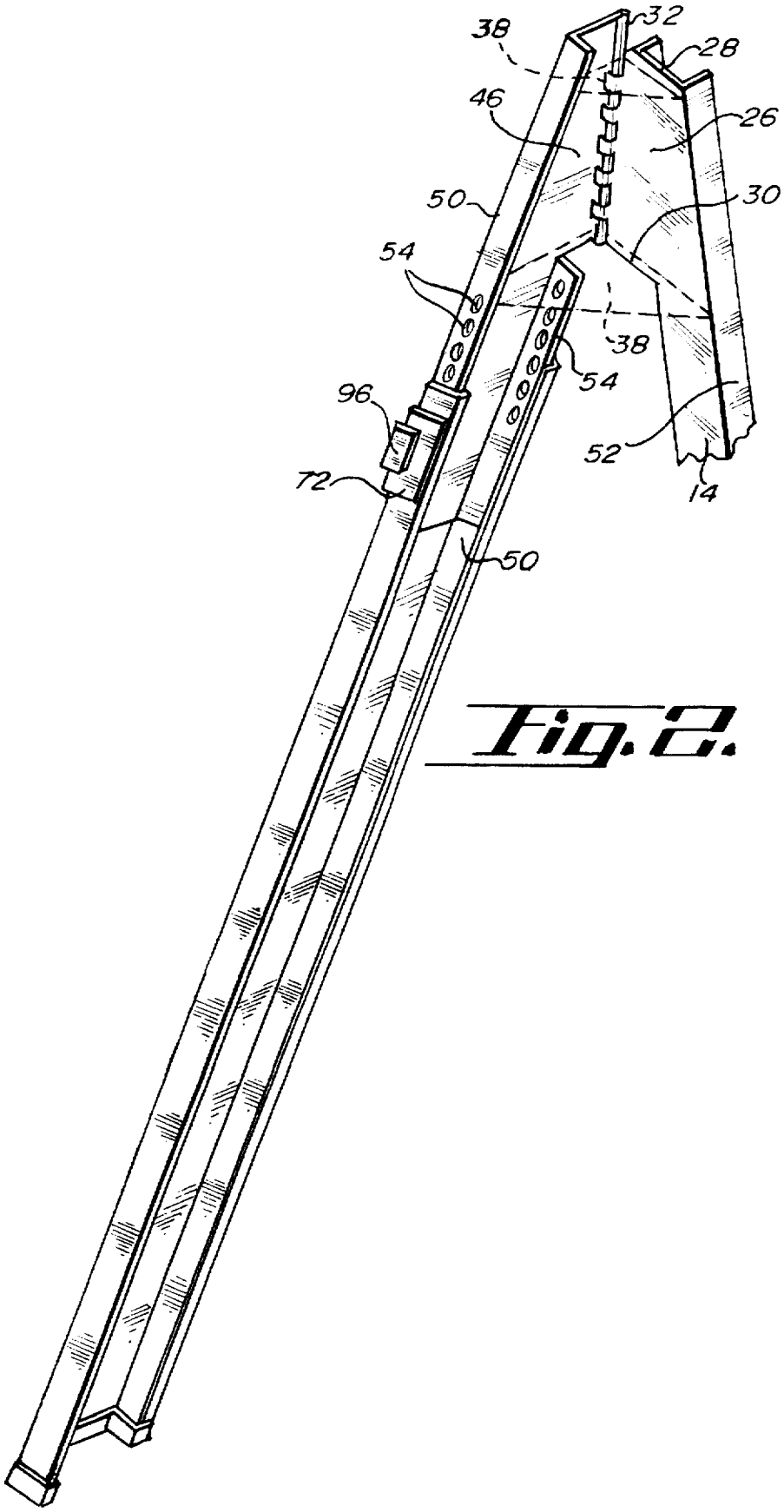
FIG. 2 is an isometric view of the ladder nesting brace with gusset plate hinge.
Figure 3:
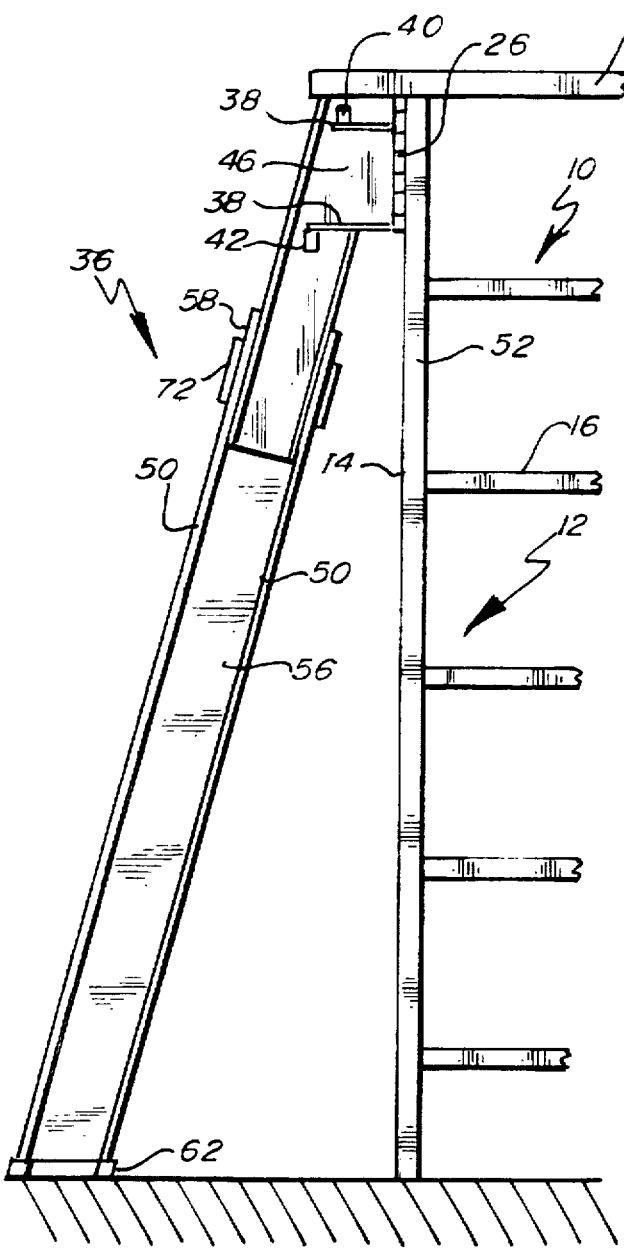
FIG. 3 is a detail front view of a nesting brace in operative position with respect to a side support rail.
Figure 4:
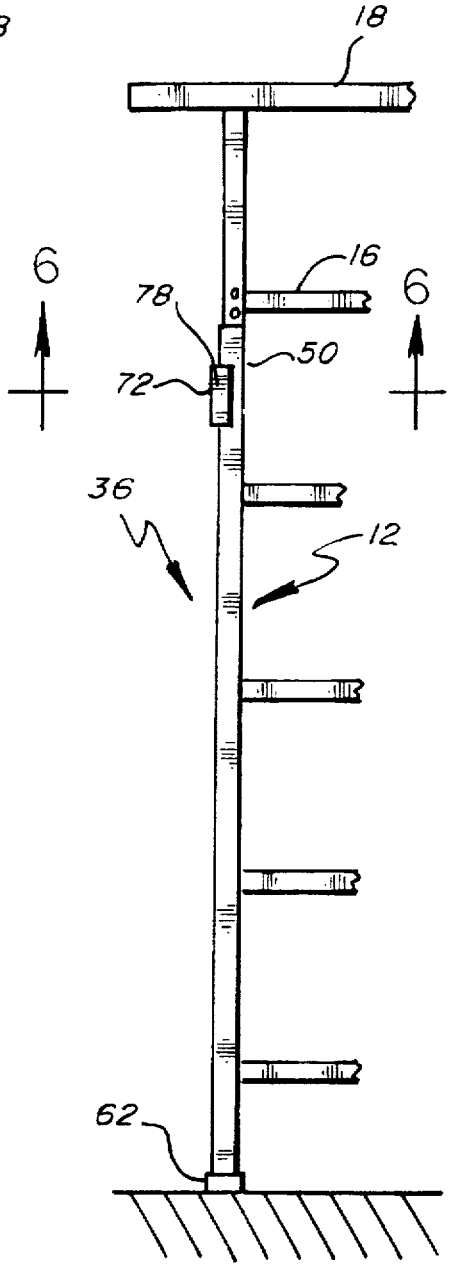
FIG. 4 is a detail front view of a nesting brace in coupling relationship to a side support rail.

One form of the invention is illustrated and described herein. In general, the ladder with nesting braces device is indicated by the numeral 10. The ladder with nesting braces device 10 is incorporated into a ladder 12 having a pair of elongate side rails 14, a plurality of rungs 16 extending between the pair of elongate side rails 14, a top shelf 18, a pair of brace legs 20 pivotally affixed to either the pair of side rails 14 or to the top shelf 18, and at least two brace leg ties 22 extending between the pair of brace legs 20. (FIGS. 1, 3 and 4)

The ladder with nesting braces device 10 may be used in conjunction with either a common step or an expandable type of ladder 12 at the preference of an individual. In the preferred embodiment, the ladder 12 is preferably formed of aluminum, fiberglass, composite or wood material, or any combination of standard accepted construction materials.

A hinge plate 26 may be incorporated into each of the pairs of elongate side rails 14 proximate to the top shelf 18. Each of the hinge plates 26 may include an upper edge 28, a lower edge 30, and an attachment edge of hinge joint 32. As best shown in FIG. 1, hinge joint 32 is upright and vertical when the ladder with nesting braces device 10 is upright. Each hinge plate 26 may be affixed to a corresponding side rail 14 by any attachment means as preferred by an individual which may include, but is not limited to, the use of screws, nuts and bolts, and/or rivets. Alternatively, each hinge plate 26 may be integral to a side rail 14.

Each hinge plate 26 is preferably of sufficient size, strength, and durability of function in and of itself, as a support mechanism for the pivotally attached nesting braces 36. In the preferred embodiment, the hinge plate 26 may have a vertical length dimension proportionate to the height of the ladder 12 and may be suitably increased in size to achieve maximized strength and stability. It should be noted that the dimensions and size proportions selected for the hinge plate 26 may be varied considerably at the discretion of an individual provided that the essential functions, features, and attributes described herein are not sacrificed.

A pair of opposed gusset plates 38 are preferably pivotally affixed to each hinge plate 26. One gusset plate 38 is preferably attached to, or is attached proximate to, the upper edge 28, and another gusset plate 38 is preferably attached to, or is attached proximate to, the lower edge 30. Each gusset plate 38 is preferably substantially triangular in shape as depicted in FIG. 5 and is formed of any sturdy metallic material as preferred by an individual. Preferably as best shown in FIG. 5, each gusset plate 38 has a gusset plate attachment edge 39 for attached to the lower edge 30 or the upper edge 28 of the hinge plate 26, a gusset plate engagement edge 41 and a gusset plate nonengagement edge 43. The gusset plate nonengagement edge 43 is disposed between the gusset plate attachment edge 39 and the plate engagement edge 41. Thus, gusset plate edges 39, 41 and 43 form the three sides of the preferred generally triangular shaped gusset plate 38. Each gusset plate 38 may include a locking mechanism which is illustrated in FIG. 5 as a locking tab 40, 42 which may either extend vertically upward or downward from the corresponding gusset plate 38 dependent upon location of the gusset plate 38 relative to either the upper edge 28 or lower edge 30. It should be noted that in alternative embodiments of the invention, an individual may elect to use a single gusset plate 38. An individual may also elect to use a single locking mechanism within an embodiment having one or two gusset plates 38, and is not restricted in options or combinations between the number of locking mechanisms and/or gusset plates 38. It should also be noted that a locking mechanism may include a dead stop (now shown) as fastened to the underside of the top shelf 18 which functions to limit the movement of the nesting brace 36 at any angle of outward rotation desired by an individual. Alternatively, the locking mechanism may be a catch which would serve as a replacement for a top gusset plate 38.

As may be seen in FIG. 5, the gusset plate 38, is pivotally affixed to the hinge plate 26 proximate to the upper edge 28, and may be manipulated inwardly and downwardly for flush engagement to the central portion of the hinge plate 26 during the positioning of a nesting brace 36 in covering relationship over a corresponding side rail 14. The direction of movement of this gusset plate 38 is opposite to the direction indicated by arrow 120 in FIG. 5. A first locking tab 40 preferably extends vertically upward from the top surface of this gusset plate 38.

The gusset plate 38 pivotally affixed to the hinge plate 26 proximate to the lower edge 30 may be manipulated inwardly and upwardly for flush engagement to the central portion of the hinge plate 26 during the positioning of a nesting brace 36 in covering relationship over a corresponding side rail 14. The direction of movement of this gusset plate 38 is opposite to the direction indicated by arrow 122 of FIG. 5. A second locking tab 42 preferably extends vertically downward from the bottom surface of this gusset plate 38.

Each gusset plate 38 is preferably horizontally and perpendicularly aligned to a corresponding side rail 14, and hinge plate 26, when a pivotally attached nesting brace 36 is fully retracted into an operative position. The rotation of a nesting brace 36 into an operative position is indicated by arrow 124 of FIG. 5. Each gusset plate 38 preferably functions to provide strength to the ladder with nesting braces device 10 for prevention of undesirable pivotal inward rotation of a nesting brace 36.

An actuating means 44 is preferably attached to each of the upper and lower edges 28, 30, respectively, and to a corresponding gusset plate 38. The actuating means 44 automatically pivots the gusset plates 38 outwardly as depicted by arrows 120, 122 into a horizontal and perpendicular position upon the pivotal retraction of a nesting brace 36 in a direction indicated by arrow 124. The actuating means 44 may be of any type as preferred by an individual including but not limited to the use of a torsion spring. (FIG. 5)

In an alternative embodiment, the use of the actuating means 44 may be eliminated. In this alternative embodiment, the pivotal rotation of a gusset plate 38 is provided by gravity for engagement to a locking mechanism.

An elongate nesting brace 36 is preferably integral and pivotally engaged to each hinge plate 26. Each nesting brace 36 preferably includes a hinge engagement section 46 positioned proximate to the top shelf 18. Each hinge engagement section 46 is adapted for affixation to a corresponding hinge joint or attachment edge 32. Each nesting brace 36 may include at least one locking mechanism depicted in this embodiment as a pocket stop 48. In the preferred embodiment, each hinge engagement section 46 preferably includes two locking mechanisms depicted in this embodiment as two oppositely aligned pocket stops 48 which are adapted for receiving engagement of either a first or second locking tab 40, 42. (FIGS. 1, 3, 4, and 5)

Each hinge engagement section 46 is preferably of sufficient size, strength and durability to function, in and of itself, as a support mechanism for the nesting brace 36. In the preferred embodiment, the hinge engagement section 46 may have a vertical length dimension proportionate to the height of the ladder 12 and may suitably be increased in size to achieve maximized strength and stability. It should be noted that the dimensions and size proportions for the hinge engagement sections 46 may be varied considerably at the discretion of an individual provided that the essential functions, features, and attributes described herein are not sacrificed.

The addition of a gusset plate 38 to a pair of hinge plates 26 transform the gusset-hinge combination into a supporting member. It is the strength and stability gained from this combination that eliminates the need for additional bracing or support of the nesting braces 36.

The oppositely aligned pocket stops 48 may be machine pressed inwardly from each hinge engagement section 46 or affixed thereto by any suitable means including but not limited to welding. Each pocket stop 48 is preferably of sufficient strength and durability to not separate from a hinge engagement section 46 during engagement to either a first or second locking tab 40, 42 during use of the ladder with nesting braces device 10. The purpose of the pocket stops 48 is to lock a corresponding gusset plate 38 to a hinge engagement section 46 during use of the ladder with nesting braces device 10. As is best shown in FIG. 5, hinge engagement section 46 is sufficiently dimensioned to fully accept engagement with gusset plate engagement edge 41. Also, as is best shown in FIGS. 1 and 5, when the gusset plate 38 is in the operative position, gusset plate engagement edge 41 is in substantially full contact with hinge engagement section 46. Any alternative engagement means or locking mechanism may be used by an individual to fixedly position a corresponding gusset plate 38 into a desired location with respect to a hinge engagement section 46, at the preference of an individual, including but not limited to the use of ledges and stops, and/or channels and grooves which function in an equivalent manner to the locking tabs 40, 42 and pocket stops 48.

A nesting brace 36 is pivotally interconnected to a side rail 14 via the engagement between the hinge plate 26 and the hinge engagement section 46. Each nesting brace 36 may therefore be easily retracted from, or coupled to, a side rail 14 at the discretion of an individual. As is best shown in FIGS. 1 and 5, when a pair of gusset plates 38 are pivotally affixed to each hinge plate 26, one of the pair of gusset plates 38 near the top shelf 18 is smaller in dimension than the other gusset plate 38.

Each nesting brace 36 preferably includes a pair of covering edges 50 which are adapted for positioning adjacent to the exterior edges 52 of a side rail 14. The covering edges 50 are preferably of a sufficient depth to permit each nesting brace 36 to flushly receive a corresponding side rail 14, facilitating transportation of the ladder and minimizing storage requirements thereof during periods of non-use. (FIGS. 1, 3, 4 and 5)

Figure 7:
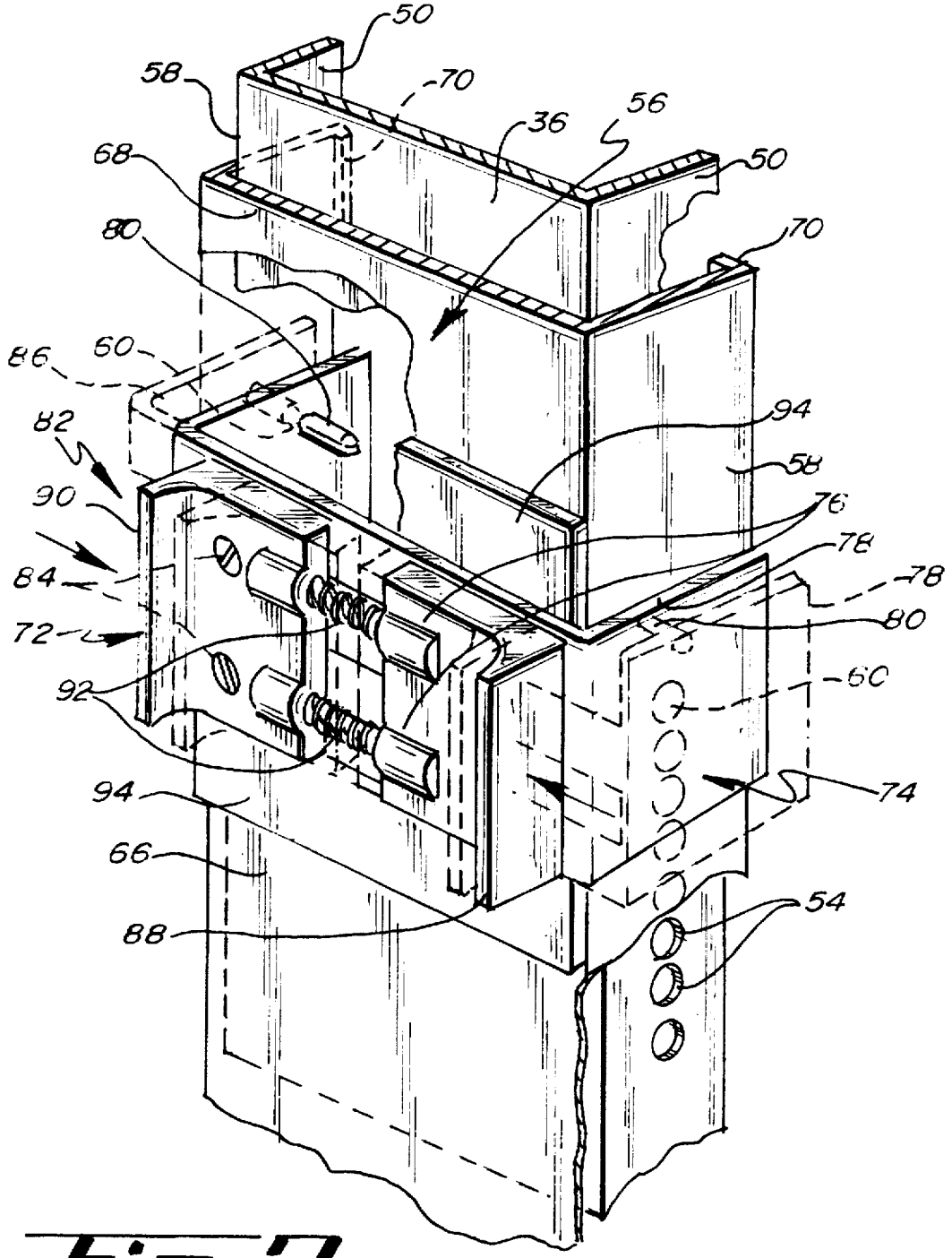
FIG. 7 is a detail isometric view of an expansible leg and carriage/housing.

As may be seen in FIG. 7, each of the covering edges 50 includes a plurality of vertically aligned and regularly spaced apertures 54 therethrough.

The nesting braces 36 function to maximize the bilateral support for the ladder with nesting braces device 10 minimizing risk and occurrence of tipping during use. The materials selected for the nesting braces 36 may significantly enhance the structural strength and durability of the ladder with nesting braces device 10, especially during use within increased load situations. The safety to an individual is thereby significantly enhanced. It should be noted that the nesting braces 36 may be formed of any sturdy material as desired by an individual which may or may not be identical to the material selected for each of the side rails 14, provided that the essential functions, features and attributes described herein are not sacrificed. (FIGS. 1, 3 and 4)

An expansible leg 56 is preferably engaged to each of the nesting braces 36. Each expansible leg 56 is also vertically adjustable with respect to a corresponding nesting brace 36 for independent and flush engagement to a non-level surface. (FIGS. 1, 3, 4 and 6)

Figure 6:
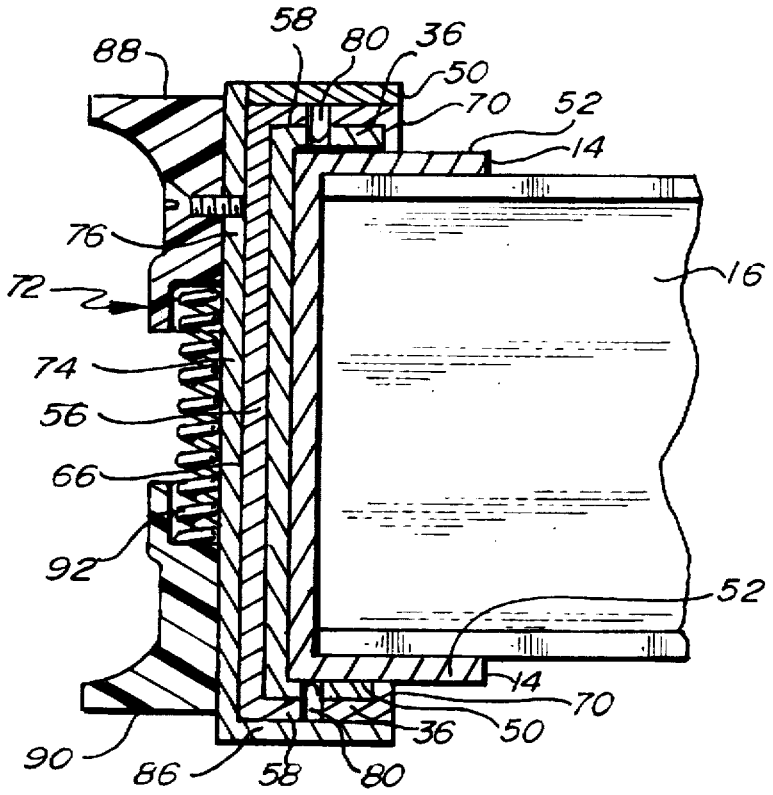
FIG. 6 is a detail cross-sectional bottom view of an expansible leg taken along the line of 6—6 of FIG. 4.

Each expansible leg 56 includes opposed engagement faces 58 having a plurality of vertically aligned and regularly spaced openings 60 therethrough. The opposed engagement faces 58 are positioned adjacent to the covering edges 50 of a corresponding nesting brace 36. The openings 60 are preferably adapted for horizontal alignment to the apertures 54 during the vertical adjustment of an expansible leg 56 with respect to a nesting braces 36. (FIGS. 6 and 7)

Figure 9:
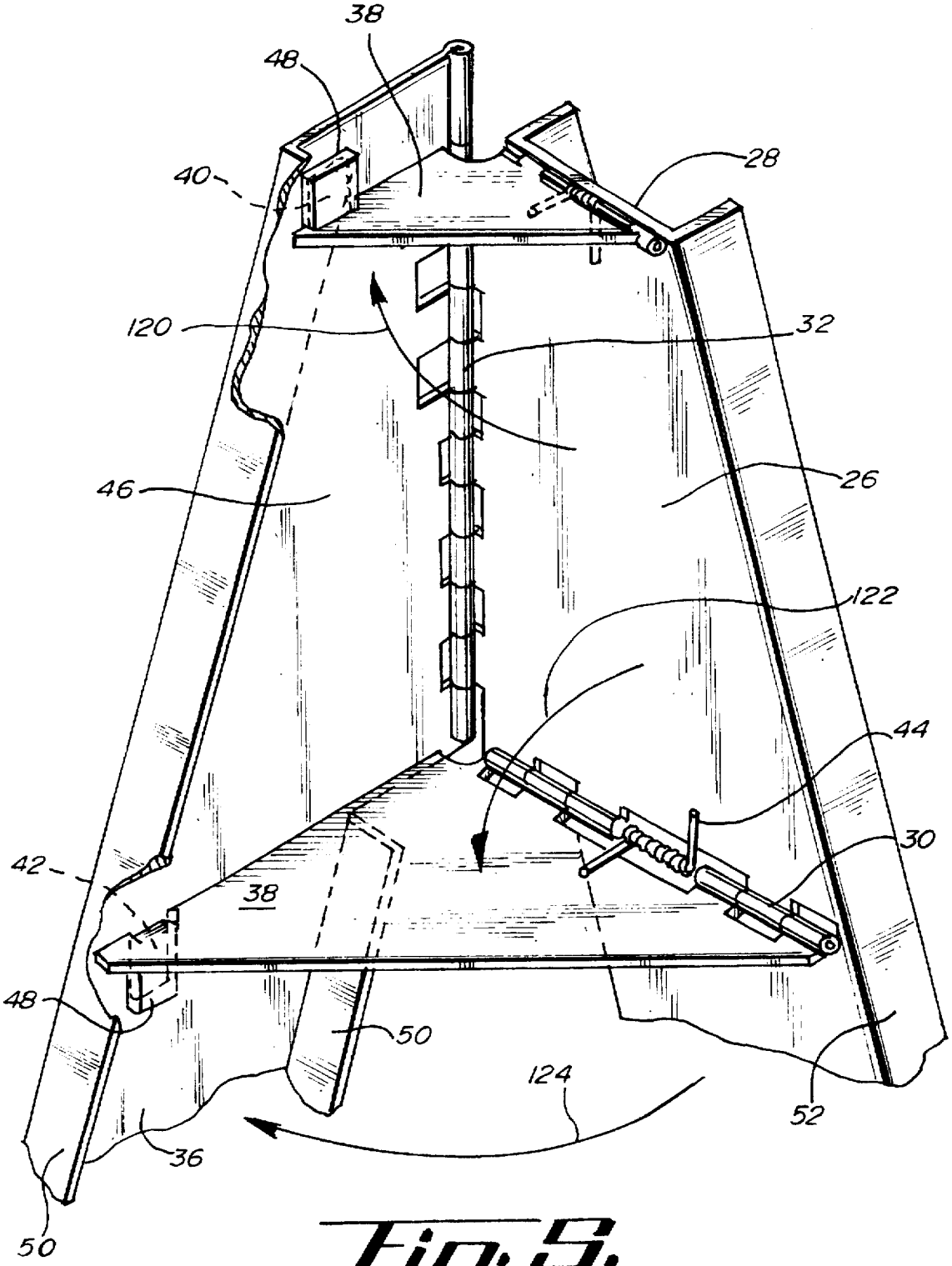
FIG. 9 is a cross-sectional side view of the carriage/housing taken along line 9—9 of FIG. 8.
Figure 8:
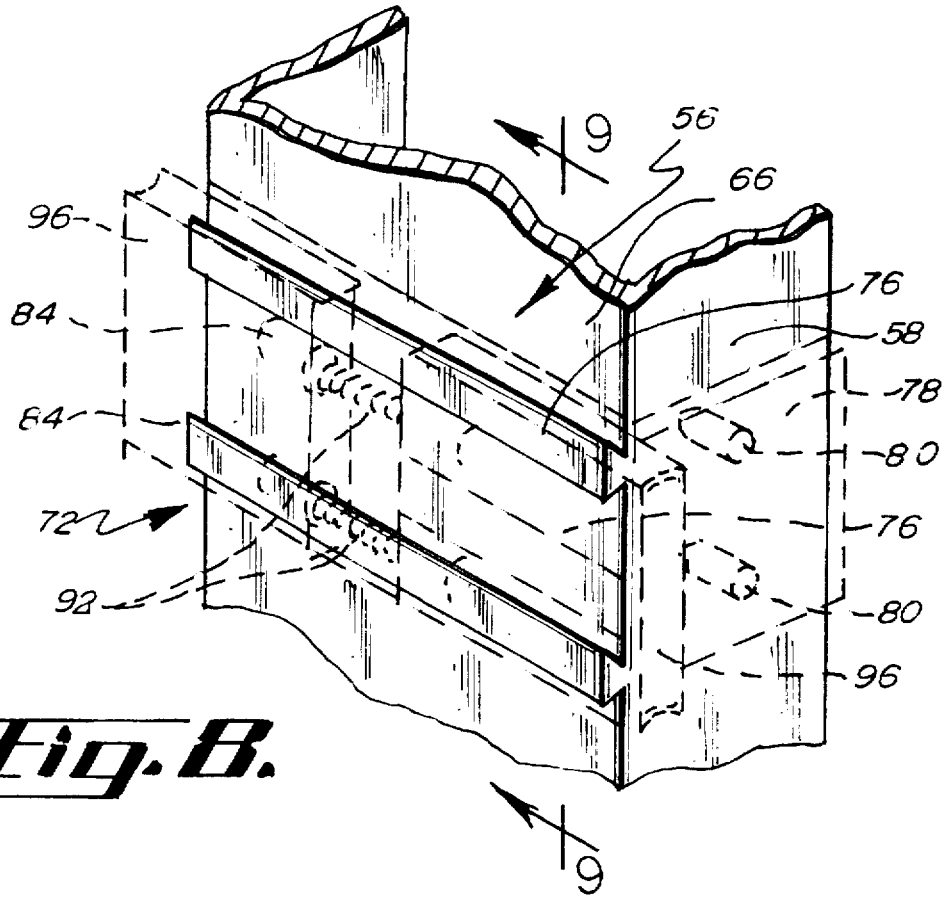
FIG. 8 is an alternate partially phantom line view of a carriage/housing.
Figure 9:
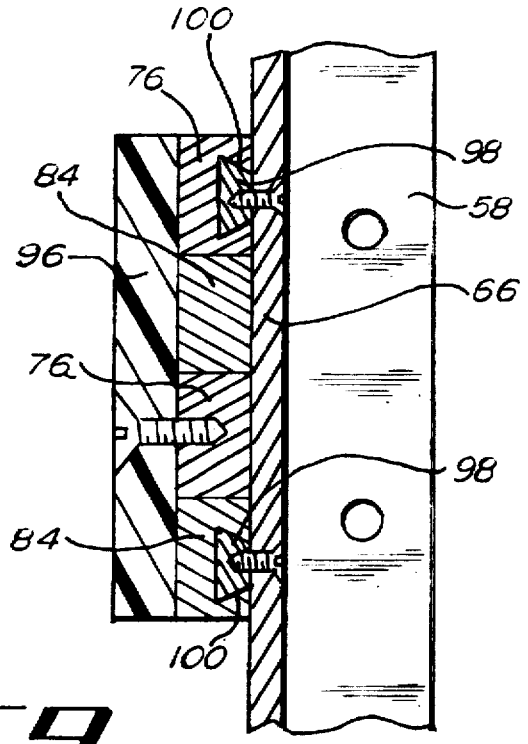

Each expansible leg 56 may also include a non-slip surface/ground engagement section 62 and a pair of parallel channels 100 which are integral to the front face 66 which we positioned proximate to the top edge 68. The non-slip surface/ground engagement section 62 preferably functions to prevent slippage of an expansible leg 56 along a surface, thereby improving the stability of the ladder with nesting braces device 10 during use. The pair of parallel channels 100 preferably function to securely position the carriage/housing 72 with respect to the front face 66 preventing undesirable elevation or descent along the expansible leg 56. (FIGS. 8 and 9)

Each expansible leg 56 additionally includes opposed and inwardly extending ledges 70 for positioning adjacent to, and enclosing, the rearward ends of the covering edges 50. The inwardly extending ledges 70 deter and prevent lateral separation of the carriage/housing 72 from a nesting brace 36. The opposed and inwardly extending ledges 70 facilitate the adjustable vertical positioning of an expansible leg 56 with respect to a corresponding nesting brace 36. (FIG. 6)

The releasable carriage/housing 72 is preferably collar-shaped and is engaged in covering relationship to a portion of the front face 66. The carriage/housing 72 covers the opposed engagement faces 58 of each of the expansible legs 56. The carriage/housing 72 preferably functions to releasably couple an expansible leg 56 to a nesting brace 36. (FIGS. 6, 7, 8 and 9)

Each carriage/housing 72 preferably includes a first slide member 74 and a second slide member 82. The first slide member 74 preferably includes a pair of first parallel slides 76, and a first affixation plate 78 which includes a plurality of inwardly extending teeth 80. The teeth 80 are adapted for engagement into the vertically aligned and regularly spaced apertures 54 of a corresponding nesting brace 36.

Each of the second slide members 82 preferably includes a pair of second parallel slides 84, and a second affixation plate 86 which includes a plurality of inwardly extending teeth 80. The teeth 80 are adapted for engagement into the vertically aligned and regularly spaced apertures 54 of a corresponding nesting brace 36.

A first grasping member 88 is preferably affixed to the exterior of the pair of first parallel slides 76 extending outwardly therefrom. A second grasping member 90 is preferably affixed to the exterior of the pair of second parallel slides 84 extending outwardly therefrom. The first and second grasping members 88, 90, respectively, may be affixed to the first and second parallel slides 76, 84 by the use of any preferred means such as screws. (FIGS. 6 and 7)

A spring return means 92 is preferably engaged to each of the first and second slide members 74, 82. The spring return means 92 is preferably positioned centrally with respect to the carriage/housing 72 approximately equal distances between each of the first and second slide members 74, 82. (FIGS. 6, 7, 8 and 9)

A positioning stop 94 may be affixed to the front face 66 adjacent to the vertical-most first parallel slide 76. A second positioning stop 94 may be affixed to the front face 66 below and adjacent to the lower-most second parallel slide 84. The first and second positioning stops 94 may function to maintain the carriage/housing 72 in a desired location with respect to the expansible leg 56. (FIG. 7)

In the preferred embodiment, the first and second parallel slides 76, 84 are alternatively positioned adjacent to each other as depicted in FIG. 7. During the vertical adjustment of the expansible leg 56, with respect to a corresponding nesting brace 36, an individual will clasp the first and second grasping members 88, 90 applying squeezing pressure therebetween. Inward pressure exerted upon the first and second grasping members 88, 90 causes the spring return means 92 to coil or contract permitting expansion of the first and second parallel slides 76, 84 outwardly from each other. The outward movement of the first and second parallel slides 76, 84 also separates the first and second affixation plates 78, 86, which in turn retracts the teeth 80 from the apertures 54. The vertical adjustment of the expansible leg 56 with respect to a nesting brace 36 may then occur. An individual may then release the first and second grasping members 88, 90 which permit the spring return means 92 to uncoil and automatically contract the first and second parallel slides 76, 84, and first and second affixation plates 78, 86 toward each other for fixed engagement of the teeth 80 into the vertically aligned and regularly spaced apertures 54. The expansible legs 56 are thereby affixed at a desired vertical position with respect to a nesting brace 36.

The engagement of the carriage/housing 72 to the expansible legs 56 may be maintained by the partial retraction of the teeth 80 from the openings 70, and by the location of the positioning stops 94 adjacent to the first and second parallel slides 76, 84. The position of carriage/housing 72 may therefore be fixed with respect to the expansible legs 56. The size and positioning of the first and second grasping members 88, 90, in conjunction with the size of the spring return means 92, may be selected in order to limit the separation of the first and second slide members 76, 84 outwardly from each other.

In an alternative embodiment, as may be seen in FIGS. 8 and 9, each of the first and second slide members 74, 82 include an outwardly extending tab 96 in replacement of the first and second grasping members 88, 90.

As depicted in FIGS. 8 and 9, the front face 66 of each expansible leg 56 includes a pair of parallel keys 98. Additionally, the vertical most first parallel slide 76 may include a channel 100 which is adapted for receiving engagement of the most vertical key 98. The lower-most second parallel slide 84 may also include a channel 100 which is adapted for receiving engagement of another key 98. In this embodiment, the sliding interaction of the keys 98 within the channels 100 function to retain the proper orientation of the carriage/housing 72 with respect to each expansible leg 56. In this embodiment, the positioning of the tabs 96, and the size of the spring return means 92, function to restrict the outward separation of the first and second slide members 74, 82, thereby preventing disengagement of the keys 98 from the channels 100. The other operational characteristics of the expansible first and second slide members 74, 82 within this embodiment are identical, with the exception of the teeth 80 which may be fully retracted from the openings 60 at the discretion of an individual.

During use of the ladder with nesting braces device 10, the expansible legs 56 may be independently adjusted for engagement to a non-level surface. During storage of the ladder with nesting braces device 10, the expansible legs 56 may be fully elevated with respect to a corresponding nesting brace 56. During storage of the ladder with nesting braces device 10, each nesting brace 56 may be rotated inwardly towards a corresponding side rail 14 for flush overlapping positioning of the covering edges 50 with respect to the exterior edges 52.

The hinge plate 26 and hinge engagement section 46 significantly improve the strength and durability of the ladder with nesting device 10 thereby significantly enhancing the safety of an individual. The gusset plates 38 significantly increase the safety of a ladder by ensuring that the fully retracted nesting braces 36 are prohibited from pivotal inward rotation towards a corresponding side rail 14 during use of the ladder 12. The automatic locking of the tabs 40, 42 within the pocket stops 48 prevents the collapsing of a nesting brace 36 towards a side rail 14 during use, which significantly improves the structural support for a ladder 12 and the safety to an individual.

The present invention may be embodied in other specific forms without departing from the spirit or essential attributes thereof; therefore, the illustrated embodiment should be considered in all respects as illustrative and not restrictive, reference being made to the appended claims rather than to the foregoing description to indicate the scope of the invention.

What is claimed:

1. A ladder comprising:

a) a pair of elongate side rails with a plurality of rungs extending horizontally between said pair of side rails; and b) a pair of elongate nesting braces, each nesting brace configured to fit around one of the side rails substantially the length of the side rail, each nesting brace vertically hingedly attached to one of the side rails when said ladder is disposed upright whereby each nesting brace is rotatable outwardly from the side rail for bracing the ladder when in use and rotatable inwardly such that each side rail nests within the respective nesting brace, wherein each nesting brace is hingedly attached to the respective side rail by a hinge having opposing hinge plates and a hinge joint, the hinge further comprises a gusset plate attached to one of the hinge plates, the gusset plate foldable between an upright position and a locking position between the opposing hinge plates to lock the nesting braces in an operative position, each of the gusset plates is biased towards the locking position such that when each nesting brace is rotated outwardly to the operative position the gusset plate automatically locks into the locking position, wherein each gusset plate has a locking tab, and one of the hinge plates has a pocket stop, the locking tab engageable with said pocket stop whereby the gusset plate is locked between the hinge plates to lock the respective nesting brace into the operative position.

2. The ladder of claim 1, wherein each nesting brace has a expansible leg attached thereto.

3. The ladder device of claim 2 wherein each nesting brace further comprises a plurality of aligned and regularly spaced apertures lengthwise along said nesting brace, and wherein the ladder further comprises a pair of carriages, each carriage attached to one of the expansible legs and engageable selectively with the apertures along the nesting brace whereby the expansible leg is adjustable on the respective nesting brace by way of the selective engagement with said apertures.

4. A ladder device comprising:

a) a pair of upright side rails;

b) a top shelf and a plurality of rungs extending between said pair of side rails;

c) a hinge connecting to each of side rails adjacent to the top shelf, each hinge having opposing hinge plates, an upright hinge joint connecting said hinge plates, when said ladder device is upright and a elongate gusset plate extendable between said hinge plates, said gusset plate having a gusset plate engagement edge, one of said hinge plates having a hinge engagement section; and d) a pair of upright braces, each of said braces hinged to one of the side rails by one of the hinges, whereby each of the braces is rotatable between a position against the respective side rails and a position for use, each gusset plate vertically extendable between the respective hinge plates into a horizontal position for locking the braces in the position for use with said gusset plate engagement edge in substantially full contact with said hinge engagement section, wherein the gusset plate is biased toward the horizontal position, and each gusset plate having a locking tab, and one of the hinge plates has a pocket stop, the locking tab engageable with said pocket stop whereby the gusset plate is locked between the hinge plates to lock the respective nesting brace into the position for use.

5. The ladder of claim 4 wherein each brace has a expansible leg attached thereto for utilizing the ladder on a non-level surface.

6. The ladder of claim 5, wherein each brace further comprises a plurality of aligned and regularly spaced apertures along said brace, and wherein the ladder further comprises a pair of carriages, each carriage attached to one of the expansible legs and engageable selectively with the apertures along the brace whereby the expansible leg is adjustable on the respective brace by way of the selective engagement with said apertures.

7. The ladder of claim 4 wherein each brace comprises a pair substantially parallel covering edges configured to fit partially around the respective side rail whereby each side rail is nestable within the respective brace.

8. A ladder device comprising:

a) a pair of side rails;

b) a plurality of rungs extending between said pair of side rails;

c) a hinge plate affixed to each said pair of side rails, each of said hinge plates having an upper and lower gusset plates, each having at least one locking mechanism, each of said hinge plates having an upper edge, an opposite lower edge and an attachment edge therebetween, said gusset plates, each having a gusset attachment edge for attaching to a respective said upper edge and lower edge, a gusset plate engagement edge and a gusset plate nonengagement edge, said locking mechanism disposed on said gusset plate engagement edge the upper gusset plates being of a smaller dimension than the lower gusset plates;

d) a pair of nesting braces, each of said nesting braces having a hinge plate engagement section pivotally engaged to said attachment edge of one of said hinge plates, each of said hinge plate engagement sections being adapted for engagement to said locking mechanism, wherein said gusset plate engagement edge is in substantially full contact with said hinge plate engagement section when said locking mechanism of said gusset plate is in engagement with said hinge plate engagement section, each of said nesting braces further having a pair of covering edges configured to nest around one of the side rails; and e) an expansible leg having a releasable carriage for adjustable engagement to each of said nesting brace, the expansible leg further configured to nest around the respective side rails.

9. A combination ladder and nesting brace device, said ladder having a pair of upright side rails and a plurality of rungs extending between said pair of side rails, said nesting brace device comprising:

a) a hinge plate integral to each of said pair of side rails, each of said hinge plates having an upper and lower gusset plates, each having a least one locking mechanism, each of said hinge plates having an upper edge, an opposite lower edge and an attachment edge therebetween, said gusset plates each having a gusset attachment edge for attaching to a respective said upper edge and lower edge, a gusset plate engagement edge and a gusset plate nonengagement edge, said locking mechanism disposed on said gusset plate engagement edge; the upper gusset plates being of a smaller dimension than the lower gusset plates, and b) a pair of upright elongate nesting braces, each of said nesting braces having a hinge plate engagement section pivotally engaged to said attachment edge of one of said hinge plates, each of said hinge plate engagement sections being adapted for engagement to said locking mechanism, wherein said gusset plate engagement edge is in substantially full contact with said engagement section when said locking mechanism of said gusset plate is in engagement with said hinge plate engagement section, each of said nesting braces further having a pair of covering edges, the nesting braces with the covering edges configured to nest around one of the side rails.

* * * * *